US006412495B1

(12) United States Patent
Belman et al.

(10) Patent No.: US 6,412,495 B1
(45) Date of Patent: Jul. 2, 2002

(54) METHOD OF FORMING A PAGE BOY HAIRSTYLE

(76) Inventors: Karen A. Belman, 166 W. 76th St., Apt. C, New York, NY (US) 10023; Heidi L. Belman, 7 Plymouth Rd., Manhasset, NY (US) 11030

( * ) Notice: Subject to any disclaimer, the term of this patent is extended or adjusted under 35 U.S.C. 154(b) by 0 days.

(21) Appl. No.: 09/681,002

(22) Filed: Nov. 1, 2000

(51) Int. Cl.[7] ..... A45D 7/00

(52) U.S. Cl. ..... 132/210; 132/251

(58) Field of Search ..... 132/200, 210, 132/245, 251, 262, 268, 273, 144, 148, 222, 223, 226, 246, 248, 250, 253, 264, 275, 276, 55, 280; D28/35, 37, 39, 41

(56) References Cited

U.S. PATENT DOCUMENTS 637,510 A * 11/1899 Holm ..... 132/280
787,903 A * 4/1905 D'Ossone ..... 132/55
1,917,341 A * 7/1933 Thau ..... 132/246
2,152,673 A * 4/1939 Solomon ..... 132/246
2,406,376 A * 8/1946 Huppert ..... 132/55
3,045,684 A * 7/1962 Stoltz ..... 132/251
3,073,318 A * 1/1963 Catania ..... 132/251
3,204,646 A * 9/1965 Chamberlin ..... 132/250
3,451,398 A * 6/1969 Marcello ..... 132/210

* cited by examiner

*Primary Examiner*—Jeffrey A. Smith
*Assistant Examiner*—Eduardo C. Robert
(74) *Attorney, Agent, or Firm*—Blumenfeld, Kaplan & Sandweiss, P.C.

(57) ABSTRACT

A hair retaining device is shown which uses a slender oversized roller and oversized hair pins (usually two). The device is intended for wearers with long hair. The hair beyond the neck is rolled on the roller and pinned to the nape of the neck, thus giving the wearer with long hair the appearance of a short hair haircut.

6 Claims, 3 Drawing Sheets

METHOD OF FORMING A PAGE BOY HAIRSTYLE

BACKGROUND OF INVENTION

1. Field of Invention

The present invention relates to hair retaining devices and more particularly to a hair retaining device specifically designed to give wearers with long hair the appearance of a short hair cut.

2. Description of Related Art

It has long been desirable to many people to keep their hair in varying styles for different occasions. In particular, depending upon the fashion of the day, it has often been desirable for women to keep their hair long for certain occasions, yet give it a shorter appearance on other occasions. One well-known shorter appearance style is commonly referred to as "page boy curls," which can be generally described as a having the ends of the hair (in back of the wearer) tucked under in a smooth roll.

The prior art contains several devices for creating page boy curls and similar styles with short appearance. U.S. Pat. No. 1,953,531 to Casper (issued in 1933) teaches the use of an elastic ligature secured to two specially designed bobby pins, the wearer's hair being curled around the ligature. U.S. Pat. No. 2,152,673 to Solomon (issued in 1939)("the '673 patent") similarly discloses netting secured at its ends to a retaining wire. The hair is then rolled around the netting and the ends of the retaining wire, which protruded beyond the ends of the netting, are bent back to secure the hair to the netting. Both of these patents disclose rolling the hair with the curled portion outside of the uncurled portion which is opposite of page boy curls.

U.S. Pat. No. 2,232,979, also to Solomon (issued in 1941), shows a device that is similar to his device in the '673 patent, except the netting is replaced by a comb and the hair style disclosed has page boy curls, the hair being tucked under. Like its predecessors, this design required the ends of the ends of the retaining wire be clamped around the end of the curl. More importantly, however, none of the aforementioned designs has means for securing the hair to the roller over the entire length of the roller. This produces an unnatural look.

U.S. Pat. No. 3,079,933, also to Solomon (issued in 1963), purported to overcome the problems of the separate clamping operation in forming page boy curls and the unnatural look produced by the prior art devices. The solution was to have a single roller with a pair of tie cords. After the hair is curled around the roller, the tie cords are brought around the forehead of the wearer and secured in front. The use of tie cords are often not desirable, however, as many women prefer to have the hair device completely concealed from observers.

It is thus the primary object of the present invention to provide a concealable hair retaining device that produces natural looking curls in a continuous roll on wearers with long hair, thus giving the appearance of a short hair cut. Other objects of the invention will become apparent from the specification described herein below.

SUMMARY OF INVENTION

In accordance with the primary object mentioned above, the present invention is a device comprising a single cylindrical roller and at least one retaining pin of approximately equal length to the roller. The roller is made of a flexible material and is preferably hollow with a series of soft teeth disposed therearound. The roller should be long (approximately 7" for the average person) and slender (½" diameter typically). The retaining pins, of which there are preferably two, may have the appearance of enormous bobby pins.

In use, the wearer, who has long hair, places the roller under her hair in back and begins to take up her hair on the roller such that the roller is between the remaining hair and her scalp. Once most of the hair in back below the hairline is taken up on the roller, retaining pins are inserted to secure the rolled hair to the nape of the neck. Ideally, the retaining pins should be about as long as the roller.

The resulting hairdo is a soft roll near the hairline in back. Thus, despite the wearer's long hair, she maintains the appearance of a short haircut such as a page boy cut.

BRIEF DESCRIPTION OF DRAWINGS

So that the manner in which the above-identified features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
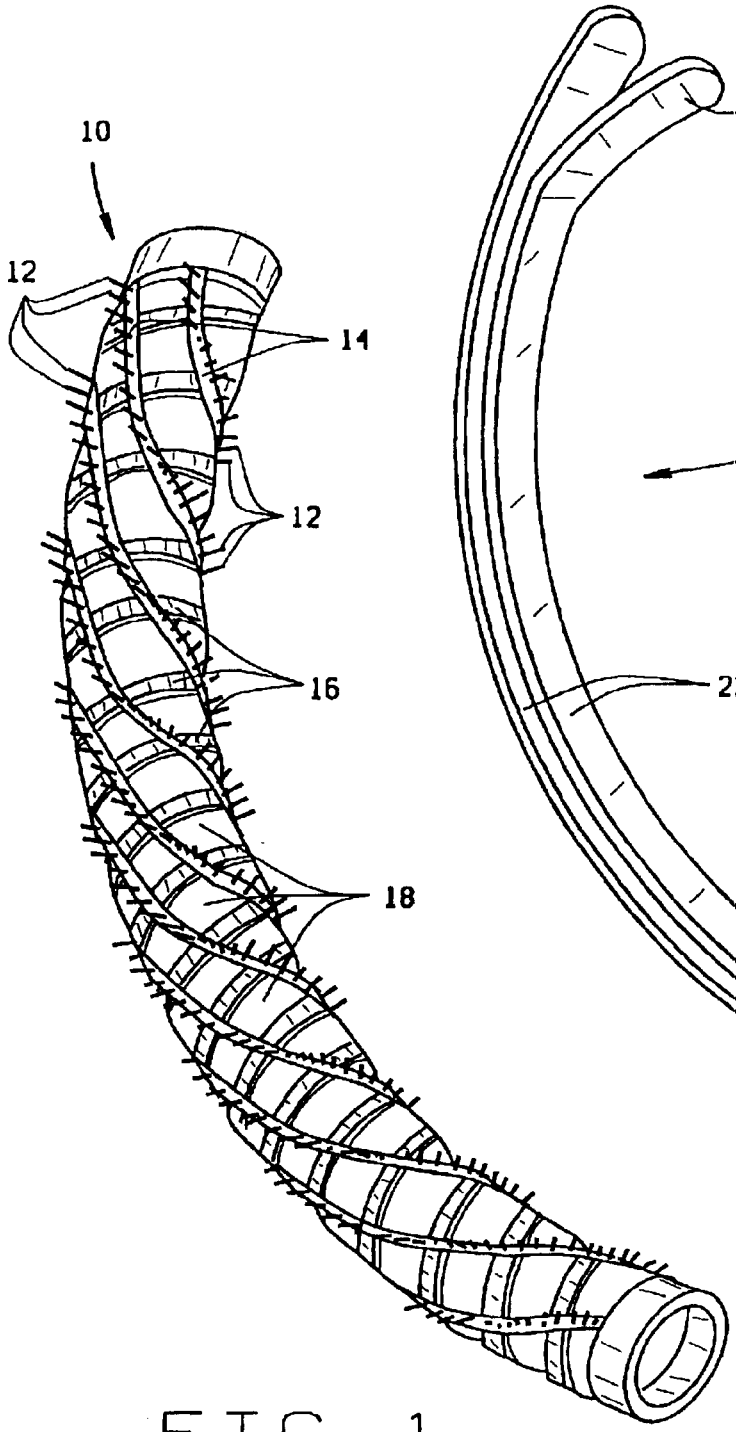
FIG. 1 is an isometric view of the roller utilized in the present invention.

Referring now to FIG. 1, the roller 10 of the present invention is shown generally. The roller 10 is cylindrical, slender, and preferably hollow. It should also be made of a flexible material, such as rubber. The roller 10 is preferably a little less than one-half circumference of the wearer's neck 28. Seven inches is the preferred length for most average users. The slenderness ratio of the roller should also be about 14:1.

Disposed about the roller 10 are a plurality of protruding teeth 12. The teeth 12 are generally made of the same material as the rest of the roller 10 and may be located on a series of helical strips 14. In the preferred embodiment there are four such helical strips 14 located 90° apart from each adjacent strip. Perpendicular to the helical strips are preferably four helical ribs 16 for support. The crisscrossing helical strips 14 and ribs 16 form a plurality of venting apertures 18, which along with the open ends of the roller 10, allow the retaining pins 20 to be inserted.

Figure 2:
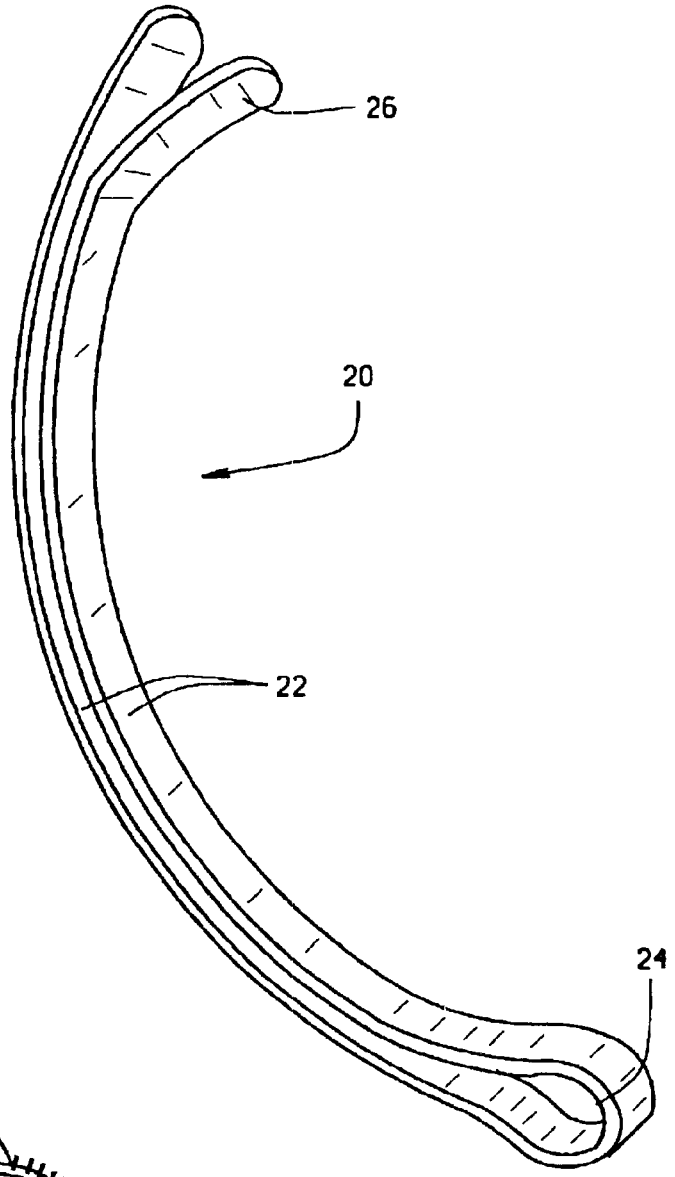
FIG. 2 is an isometric view of the retaining pin utilized in the present invention.
Figure 3:
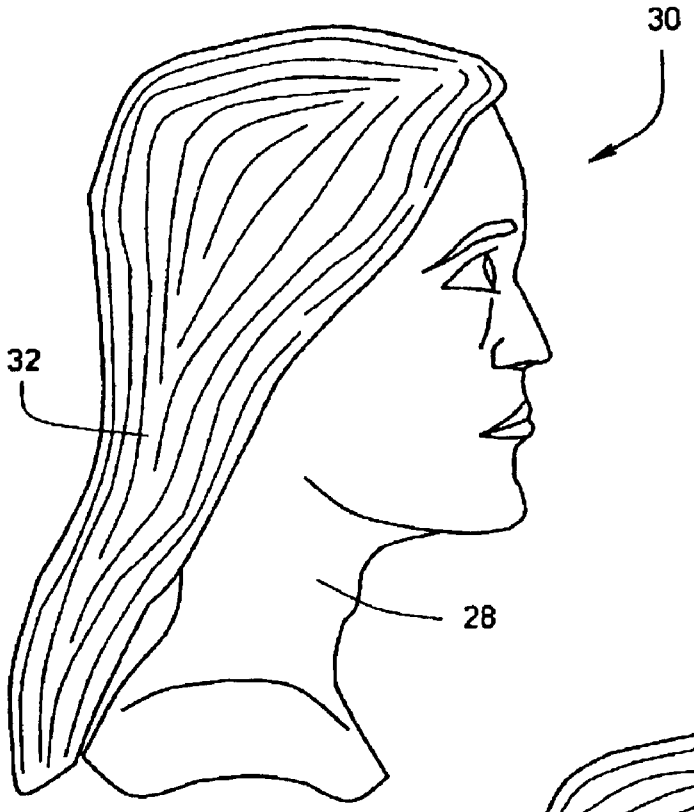
FIG. 3 is a side view of a potential wearer having long hair, without the present invention in place.
Figure 4:
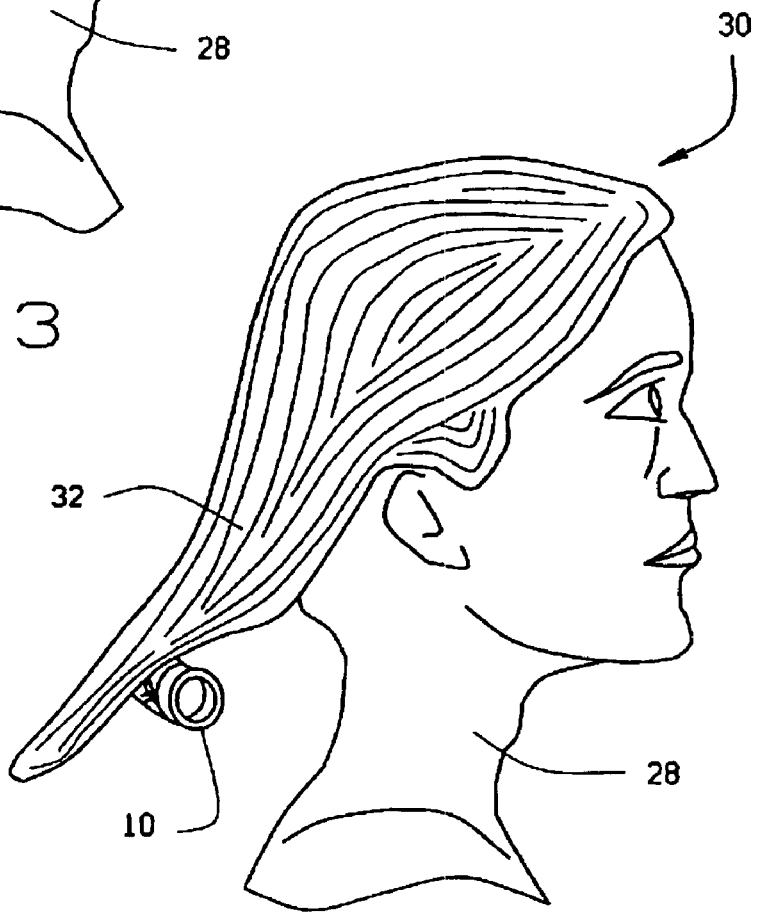
FIG. 4 is a side view of the wearer of FIG. 3 showing the initial insertion of the roller of FIG. 1.
Figure 5:
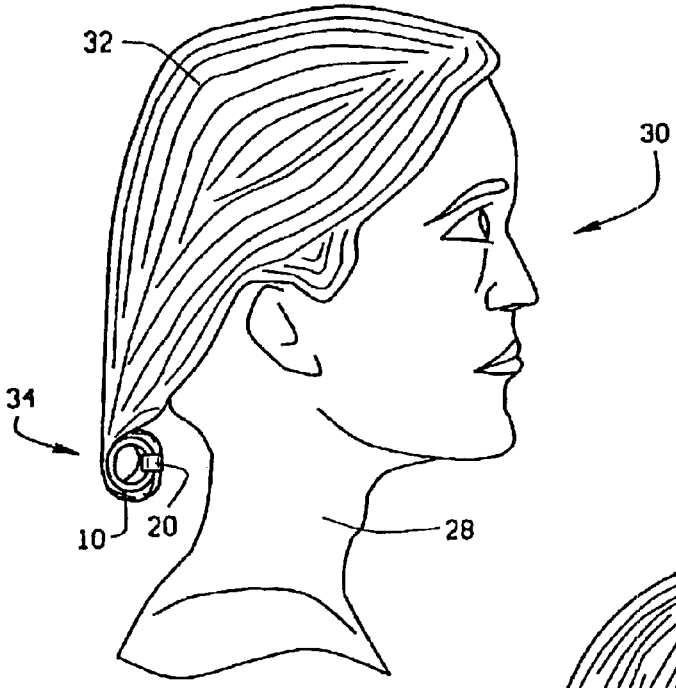
FIG. 5 is a side view of the wearer of FIG. 3 showing present invention in place, but further away from the neck than would typically be used.

FIG. 2 shows the preferred embodiment of the retaining pin 20 for the present invention. The retaining pin 20 should be approximately equal in length to the roller 10, and preferably resembles a gigantic bobby pin. The preferred retaining pin 20 is metal and has two legs 22 that integrally meet in a small loop 24 at one end. At the opposite end from the loop 24, one leg 22 may have a tail 26 that flares out slightly. The retaining pin 20 should also be slightly curved with a radius of curvature a little larger than the neck 28 of the wearer 30. Only one roller 10 is needed per wearer 10, but each roller 10 should be used with a plurality of retaining pins 20 preferably two, although more is acceptable.

As seen in FIGS. 3–7, the wearer 30 takes all of her hair 32 behind her neck 28 and begins to curl it around the roller 10. The roller 10 should start on the underside of the hair 32 and take up the hair 32 so that a roll of hair 34 forms adjacent to the neck 28 and tucked underneath the remainder of the hair 32.

Figure 6:
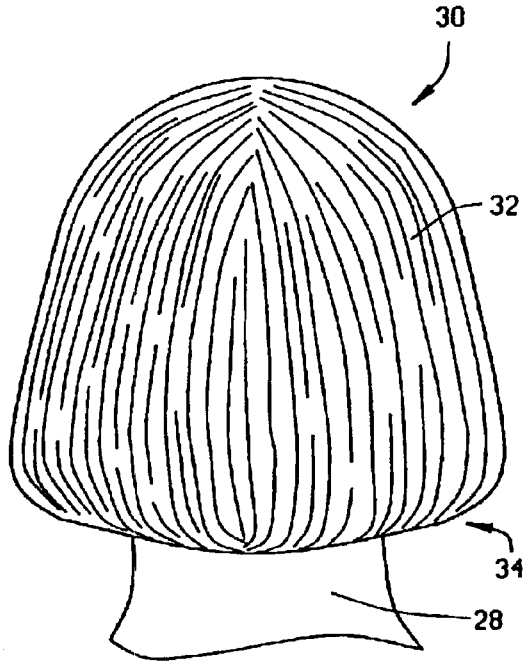
FIG. 6 is a rear view of the wearer of FIG. 3 showing the appearance of the hair with present invention properly in place.
Figure 7:
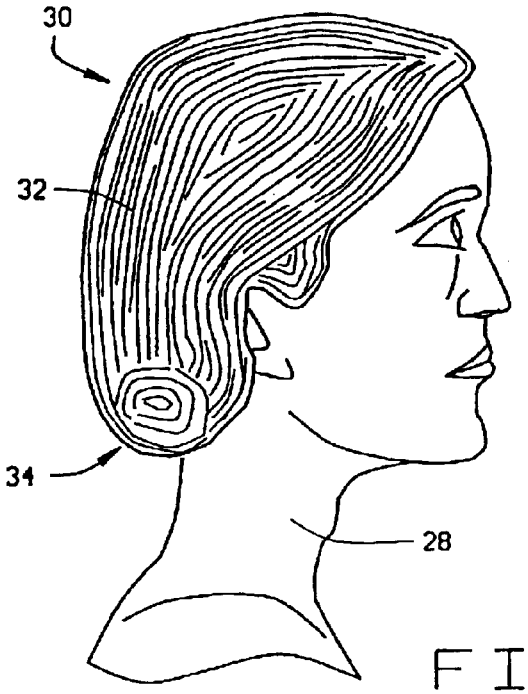
FIG. 7 is a side view of the wearer of FIG. 6.

Once the hair 32 is taken up in the roll 34 to the neck 28, the retaining pins 20 are inserted to secure the roll 34 close to the hairline on the nape of the neck 28. Thus, the hair 32 is preferably fully taken up on the roll 34 before the retaining pins 20 are inserted. Only one of the hairpins 20 is visible in FIG. 5, as the second pin is preferably inserted from the far side. Additionally, the roll 34 shown in FIG. 5 should actually be abutting the neck, as the roll is pinned directly to the hair at the nape of the neck; however the roll 34 is shown away from the neck 28 in this case for clarity. FIGS. 6 and 7 show the roll 34 in the proper position in relation to the neck 28. FIGS. 6 and 7, thus show the resulting look, which gives the wearer 30 the appearance of a short "page boy" haircut. However, when the wearer 30 chooses to return to a long-hair look (FIG. 3), she can simply remove the retaining pins 20 and the roller 10.

While the foregoing is directed to the preferred embodiments of the present invention, other and further embodiments of the invention may be devised without departing from the basic scope thereof, and the scope thereof is determined by the claims, which follow.

We claim:

1. A method of forming a page boy hairstyle on a wearer having a neck of a given diameter and shoulder length hair comprising the steps of:

rolling the hair behind the neck of the wearer around a flexible cylindrical roller, thereby curling the hair, the roller having a length at least the majority of one diameter of the neck of the wearer; and inserting at least one retaining pin through the roller, thereby securing the roller to the now curled hair of the wearer, and thus creating a page boy hairstyle.

2. The method of claim 1, wherein the roller further comprises a series of teeth disposed therearound.

3. The method of claim 2, wherein the roller is hollow.

4. The method of claim 1, wherein the roller has a slenderness ratio of at least approximately 1:14.

5. A method of forming a page boy hairstyle on a wearer having a neck of a given diameter and shoulder length hair comprising the steps of:

rolling the hair behind the neck of the wearer around a flexible cylindrical roller, thereby curling the hair, the roller having a length at least the majority of one diameter of the neck of the wearer;

inserting at least one retaining pin through the roller, thereby securing the roller to the now curled hair of the wearer, and thus creating a page boy hairstyle; and wherein each retaining pin is integrally comprised of two curved prongs having approximately equal curvature, said prongs joined at one end in a U-shaped joint.

6. The method of claim 5, wherein the wearer has a scalp wherein one prong is inserted on the inside of said roller and a second prong is disposed adjacent the scalp at the nape of the neck of the wearer.

* * * * *